US006416075B1

(12) United States Patent
Laughlin et al.

(10) Patent No.: US 6,416,075 B1
(45) Date of Patent: Jul. 9, 2002

(54) TOOL-FREE ADJUSTABLE BINDING STRAP

(75) Inventors: James Laughlin, Burlington; Ryan Coulter, Stowe, both of VT (US); Benjamin Beck; Thomas Powers, both of Boston, MA (US); Glen V. Walter, Boxford, MA (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/560,094

(22) Filed: Apr. 28, 2000

(51) Int. Cl.[7] ..... A63C 9/14
(52) U.S. Cl. ..... 280/624; 280/14.2
(58) Field of Search ..... 280/600, 601, 280/607, 611, 613, 617, 619, 620, 633, 634, 635, 14.2; 36/115, 116, 117.1, 117.9, 118.1

(56) References Cited

U.S. PATENT DOCUMENTS

| | | | | | |
|---|---|---|---|---|---|
| 1,678,579 | A | * | 7/1928 | Vincent | 280/600 |
| 2,023,054 | A | * | 12/1935 | Mandelid | 280/619 |
| 2,130,693 | A | | 9/1938 | Nashe et al. | 280/11.35 |
| 2,235,164 | A | * | 3/1941 | Pfeiffer | 280/619 |
| 3,044,792 | A | | 7/1962 | Osborn et al. | 280/11.35 |
| 3,155,398 | A | | 11/1964 | Marker | 280/11.35 |
| 3,649,039 | A | | 3/1972 | Gertsch et al. | 280/11.35 P |
| 3,724,866 | A | * | 4/1973 | Kaplan | 280/607 |
| 3,936,063 | A | | 2/1976 | Sittmann | 280/11.35 P |
| 4,083,578 | A | | 4/1978 | Moog et al. | 280/618 |
| 4,522,422 | A | | 6/1985 | Jaeger | 280/617 |
| 4,592,734 | A | | 6/1986 | Metiver | 441/74 |
| 4,693,199 | A | | 9/1987 | Omachen et al. | 114/39 |
| 4,718,181 | A | | 1/1988 | Olivieri | 36/119 |
| 4,969,655 | A | | 11/1990 | Katz | 280/14.2 |
| 5,143,396 | A | | 9/1992 | Shaanan et al. | 280/607 |
| 5,147,234 | A | * | 9/1992 | Brug | 441/70 |
| 5,362,087 | A | | 11/1994 | Agid | 280/611 |
| 5,556,123 | A | | 9/1996 | Fournier | 280/607 |
| 5,692,765 | A | | 12/1997 | Laughlin | 280/619 |
| 5,758,895 | A | | 6/1998 | Bumgarner | 280/607 |
| 5,769,446 | A | * | 6/1998 | Borsoi | 280/623 |
| 5,906,058 | A | * | 5/1999 | Rench et al. | 36/117.1 |
| 5,918,897 | A | | 7/1999 | Hansen et al. | 280/611 |
| 5,927,744 | A | | 7/1999 | Knapschafer | 280/619 |
| 6,009,638 | A | * | 1/2000 | Maravetz et al. | 36/115 |
| 6,056,300 | A | * | 5/2000 | Carpenter et al. | 280/14.2 |
| 6,056,312 | A | | 5/2000 | Hogstedt | 280/624 |
| 6,113,114 | A | * | 9/2000 | Zemke et al. | 280/14.26 |

FOREIGN PATENT DOCUMENTS

| | | | |
|---|---|---|---|
| EP | 0 852 958 A1 | 7/1998 | |
| FR | 2 758 468 A1 | 7/1998 | |
| GB | 2196905 A | 11/1988 | B63B/35/86 |
| JP | 09-187543 A | 7/1997 | |
| JP | 10-248990 A | 9/1998 | |

OTHER PUBLICATIONS

US 6,062,576, 05/2000, Carpenter et al. (withdrawn)*.
IDS Appendix—Burton Adjustable Strap Binding.
Translation of Japanese Patent Application Publication No. 9–187543.

* cited by examiner

*Primary Examiner*—Brian L. Johnson
*Assistant Examiner*—Bridget Avery
(74) *Attorney, Agent, or Firm*—Wolf, Greenfield & Sacks, P.C.

(57) ABSTRACT

A method and apparatus for tool-free adjustment of a binding strap on a snowboard binding. A snowboard binding may include a base, at least one binding strap, and at least two strap mounting features, supported by the base, adapted to mount the at least one binding strap to the base in at least two mounting positions. The strap mounting features and the at least one binding strap may be configured to allow the at least one binding strap to be selectively moved between the at least two strap mounting positions without tools while the base is attached to a snowboard.

28 Claims, 4 Drawing Sheets

TOOL-FREE ADJUSTABLE BINDING STRAP

FIELD OF THE INVENTION

This invention relates to snowboard binding straps.

BACKGROUND OF THE INVENTION

Snowboard bindings are used to attach a rider's feet to a snowboard. One type of binding includes a base that is attached to a snowboard and into which the rider places a foot. One or more straps on the binding are attached to the base and secure the foot to the base. For example, one strap on the binding may have two sections that are attached to opposite sides of the base and extend over the rider's foot. A buckle, such as a ratcheting-type buckle, can be used to join the two strap portions and tighten the strap down atop the rider's foot. Conventionally, snowboard bindings have two straps, a toe strap and a heel (or ankle) strap.

Conventional bindings enable the position where the straps attach to the base to be adjusted, e.g., to accommodate riders that have differently sized feet. Binding straps are typically attached to the binding base by a screw, and so require a tool to adjust the strap position. The assignee of the present application has developed a binding strap arrangement that allows the position at which a toe strap is attached to the base of the binding to be adjusted without the use of tools. However, this arrangement requires that the binding base be detached from a snowboard before the adjustment can be made. That is, once the strap is positioned on the base and the base is attached to a snowboard, no adjustment in the strap attachment position relative to the base can be made until the base is removed from the snowboard, which typically requires a tool.

SUMMARY OF THE INVENTION

One illustrative embodiment of the invention provides a snowboard binding including a base, at least one binding strap, and at least two strap mounting features supported by the base. The strap mounting features are adapted to mount the at least one binding strap to the base in at least two mounting positions. The strap mounting features and the binding strap are configured to allow the at least one binding strap to be selectively moved between the at least two strap mounting positions without tools while the base is attached to a snowboard.

Another illustrative embodiment of the invention is directed to a snowboard binding including a base, at least one binding strap having a resilient end, and at least two strap mounting features supported by the base. The strap mounting features are adapted to mount the at least one binding strap to the base in at least two mounting positions. The strap mounting features and the binding strap are configured to allow the at least one binding strap to be selectively moved between the at least two strap mounting positions. The resilient end tends to retain the strap end in one of the mounting positions and is deformable to allow the strap to be selectively disengaged from the one of the mounting positions and moved to another of the mounting positions.

Another illustrative embodiment of the invention is directed to a snowboard binding including a base, at least one binding strap, and at least two strap mounting features supported by the base. The strap mounting features are adapted to mount the at least one binding strap to the base in at least two mounting positions. The strap mounting features and the binding strap are configured to allow the at least one binding strap to be selectively moved between the at least two strap mounting positions. A resilient shelf attached to the base tends to retain the binding strap in one of the mounting positions and is deformable to allow the strap to be selectively disengaged from the one of the mounting positions and moved to another of the mounting positions.

In a further illustrative embodiment, a snowboard binding is provided including a base, at least one binding strap, and a detent supported by the base. The detent is adapted to mount the at least one binding strap to the base in at least two mounting positions, and the detent and the at least one binding strap are configured to allow the at least one binding strap to be selectively moved between at least two strap mounting positions without tools while the base is attached to a snowboard.

In another illustrative embodiment, a method is provided for adjusting a binding strap on a snowboard binding. A binding base mounted on a snowboard is provided, and at least one binding strap is adjusted from a first mounting position on the base to a second mounting position on the base without using tools and while the binding base is attached to the snowboard.

In a further illustrative embodiment, a snowboard binding is provided including binding means for attaching a rider's foot to a snowboard, and means for allowing adjustment of at least one binding strap from a first mounting position on the binding means to a second mounting position on the binding means without using tools and while the binding means is attached to the snowboard.

BRIEF DESCRIPTION OF THE DRAWINGS

Embodiments of the invention are described with reference to the following drawings, in which like reference numerals refer to like elements and, wherein.

DETAILED DESCRIPTION

In one illustrative embodiment, a snowboard binding is provided with one or more binding straps that can be moved from a first mounting position on a binding base to a second mounting position on the binding base without the use of a tool, e.g., a coin, a screwdriver, wrench, etc., and without removing the binding base from a snowboard.

Figure 1:
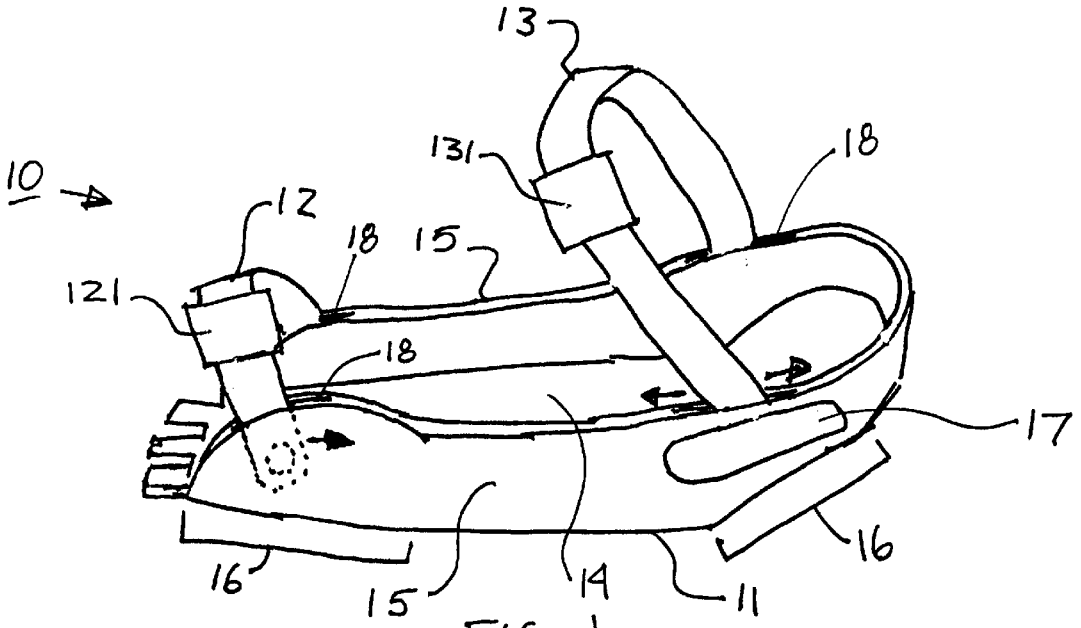
FIG. 1 is a perspective side view of a snowboard binding according to one illustrative embodiment of the invention.

One exemplary embodiment is shown in FIG. 1. In this embodiment, a binding 10 includes a base 11, a toe strap 12 and an ankle strap 13. The base 11 includes a bottom 14 and side flanges 15 that extend upwardly from the bottom 14. The binding base 11 can be made of any suitable material, as the invention is not limited in this respect. For example, the base 11 can be made from a rigid or semi-rigid light-weight and strong material, such as a plastic or aluminum. The base 11 is also adapted to be mounted to a snowboard. For example, the bottom 14 can be equipped with mounting holes that can be used with mounting screws to attach the base 11 to a snowboard. The bottom 14 can alternatively be equipped with a mounting hole that engages with a hold down disk, as is well known in the art. In short, any method for attaching the base 11 to a snowboard can be used, as the invention is not limited by the manner in which the binding 10 is attached to the snowboard.

The binding 10 can also include a conventional high-back, toe pad and/or other features as are well known in the art. The bottom 14 of the binding 10 shown in FIG. 1 includes three finger-like extensions that engage with a toe pad. However, the bottom 14 could have a smooth front with no extension, and/or a built-in toe pad. Since these optional devices are not relevant to the invention, they are not shown and are not described in detail.

Opposite ends of the straps 12 and 13 are attached to the side flanges 15 at detents 16 in the side flanges 15. The straps 12 and 13 also include fastening mechanisms 121 and 131, respectively, that are used to tighten the straps 12 and 13 around a rider's toe and ankle portion of the foot. The straps 12 and 13 may have two strap sections such that each strap section is individually attached to the base 11 at a respective detent 16. The fastening mechanisms 121 and 131 can be of any type as the invention is not limited to use with any particular fastening mechanism. For example, the fastening mechanisms 121 and 131 may be ratchet-type buckles that are fixed to one strap section and engage with the other strap section so that the overall strap length can be shortened to tighten around the rider's foot. Alternately, the fastening mechanisms 121 and 131 can be any type of device that adjusts the length of the strap 12 and 13, such as buckles, D-rings, pawl mechanisms, and the like. The straps 12 and 13 can also include other features, such as pads or other portions to distribute the strap's retaining force on the rider's foot, although the invention is not limited in this respect.

The detents 16 in this embodiment allow a rider to adjust the position where the straps 12 and 13 attach to the base 11 without using tools and while the base 11 is attached to a snowboard. Although in this example the detents 16 are formed as part of the side flanges 15, the present invention is not limited in this respect, as the detents 16 could be separate devices that are supported by the side flanges 15 and/or the bottom 14.

It should be appreciated that the detents 16 can be configured to operate in a variety of ways. In this respect, the term detent is used herein to refer to any device that keeps a strap 12 or 13 at a certain mounting position relative to the base 11, and that may release the strap 12 or 13 from the mounting position for movement to another mounting position by the tool-free application of a force on one or more parts of the detent 16. Although several of the embodiments for the detents 16 described below include a resilient portion that deforms to allow strap adjustment, it should be understood that the specific operation of the detents 16 regarding how a strap 12 or 13 is moved and retained at a specific mounting position may be different from the illustrative embodiments described below. For example, the detents 16 may be modified to omit the resilient portion and allow movement of the straps 12 and 13 to different mounting positions without deforming any member.

In the embodiment shown in FIG. 1, the detent 16 includes a slot 18 formed, for example, in the side flanges 15. The ends of the straps 12 and 13 are adjustable toward the heel or toe ends of the base 11 to different mounting positions within the slots 18 without the use of tools, and while the binding 10 is attached to a snowboard.

Figure 2:
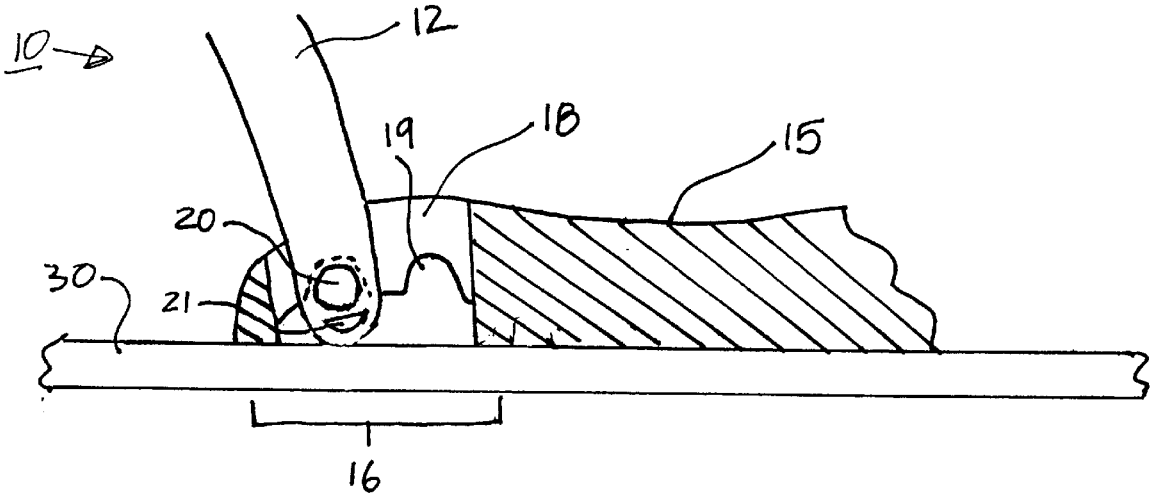
FIG. 2 is a cross-sectional side view of the toe strap mount portion of a side flange of the snowboard binding of FIG. 1.

FIG. 2 shows a cross-sectional side view of the detent 16 that is near the toe portion of the base 11 and engages with an end of the toe strap 12. In FIG. 2, the binding 10 is attached to a snowboard 30. The slot 18 is formed in the side flange 15 and extends from a top edge of the side flange 15 through the bottom edge of the side flange 15. Thus, a lower portion of the strap 12 contacts a top surface of the snowboard 30. However, it should be understood that the slot 18 need not be formed all the way through the side flange 15. Instead, the slot 18 could extend from a top edge of the side flange 15 only partially through the side flange 15. In this case, a lower portion of the strap 12 would contact a lower portion of the slot 18, rather than a top surface of the snowboard 30. The slot 18 also need not be the same height relative to the bottom 14 along its entire length, but can vary in height, as shown in FIG. 2.

In the embodiment shown, at least one sidewall of the slot 18 includes two recesses 19. The recesses 19 engage with a tab 20 on the strap 12 so that the strap 12 cannot be withdrawn upwardly from the slot 18. The tab 20 is any raised portion on one or both sides of the strap 12 than can engage with a recess 19. Although in this example only two recesses 19 are shown in the slot 18, more than two recesses 19 may be used. Likewise, the recesses 19 may be formed in different sizes and shapes, in different locations and at different spacings. For example, the recesses 19 may be spaced relatively further apart or closer together than that shown in FIG. 2, and/or the recesses 19 may be formed in the bottom 14 rather than the side flanges 15. The recesses 19 may also be replaced with other mounting features that engage with the strap 12. For example, the recesses 19 may be replaced with raised portions on the slot 18 sidewall that engage with a hole or groove in the strap 12.

The lower end of the toe strap 12 in this example has an aperture 21 formed through the strap 12. Since the strap 12 is preferably made of a material, e.g., plastic, that is semi-rigid when in tension or compression, this aperture 21 allows the end of the strap 12 to be deformed so that the aperture 21 may be closed or nearly closed. Thus, by pushing down on the end of the strap 12 with a disengaging force, the rider can deform the strap 12 end, allowing the tab 20 to move toward the snowboard 30 and disengage from the recess 19. Once the strap 12 end is deformed and the tab 20 is disengaged from the recess 19, the strap 12 can be moved along the slot 18 toward the heel or toe end of the base 11 and can be engaged with a different recess 19. The aperture 21 makes the strap 12 end more compliant than other portions of the strap 12, and as a result the end deforms and the aperture 21 closes or nearly closes. In the absence of a disengaging force, the strap 12 elastically recovers to open the aperture 21 and tends to engage the tab 20 with the recess 19 below which it is positioned.

Figure 3:
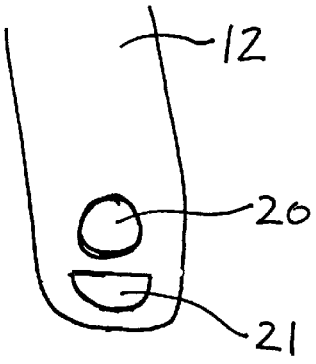
FIG. 3 is a side view of a binding strap end having an aperture formed therethrough in accordance with one embodiment of the invention.

FIG. 3 is an enlarged view of the end of the strap 12 shown in FIG. 2. In this embodiment, a resilient end is formed at the end of the strap 12 via an aperture 21 having a semicircular shape. It should be appreciated that the present invention is not limited in this respect, as the aperture 21 can have other shapes, and/or two or more apertures 21 of any shape may be provided. Further, any feature, such as one or more grooves or channels, may be formed in the strap 12 in addition to or in place of the aperture 21 to form the resilient end. Thus, any feature that allows the end of the strap 12 to deform in the presence of a disengaging force and allows the end of the strap 12 to elastically recover to some extent when the disengaging force is released can be used.

Figure 4:
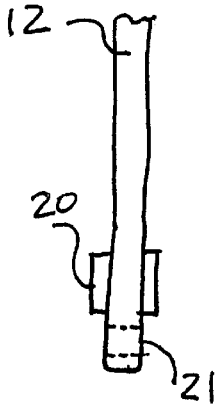
FIG. 4 is an edge view of the binding strap of FIG. 3.

FIG. 4 shows an edge view of the strap 12. As shown in dotted line, in one embodiment, the aperture 21 passes entirely through the strap 12. However, an aperture 21, groove or other feature passing entirely through the strap 12 is not required. For example, the aperture 21 could be filled with a relatively easily deformed, but highly elastic, material or portions of the strap 12 end may be cut away at one or both sides (but left solid in the middle). The tab 20 in the embodiments shown in FIGS. 1–5 is a cylindrical plastic or metallic plug that fits snugly within a hole formed in the strap 12. However, the invention is not limited in this respect as the tab 20 can be formed in other ways, and can have other shapes. For example, the tab 20 can be a molded feature of the strap 12, a metallic rivet, a button that is attached to the side of the strap 12, and so on. In addition, the tab 20 is not limited to being circular, and can have any shape compatible with a corresponding recess 19 or other mounting feature to receive the tab 20.

Figure 5:
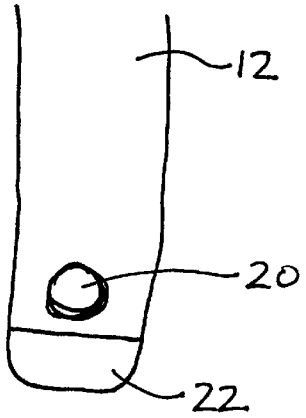
FIG. 5 is a side view of a binding strap having a resilient member attached to an end of the strap in accordance with another embodiment of the invention.

FIG. 5 shows another embodiment of a strap 12 end having a resilient member 22 attached to the strap 12 end. In this embodiment, the resilient member 22 is not formed by any apertures or other features formed in the strap 12. Instead, the resilient member 22 is made of a more resilient material than the body of the strap 12, so that the resilient member 22 can deform and allow the tab 20 to disengage from the recess 19 when a disengaging force is placed on the strap 12. Other arrangements are also possible. For example, one or more leaf springs or coil springs can be attached to the end of the strap 12. In short, any structure that resiliently urges the tab 20 into engagement with a recess 19, but can deform to allow the strap 12 to be disengaged from a first mounting position and moved to a second mounting position, may be used. It is also possible that a resilient member 22 could be attached to the end of the strap 12 above the tab 20. For example, a rubber sleeve could be attached to the strap 12 above the tab 20 so that when the strap 12 is moved downward to disengage the tab 20 from a recess 19, the rubber sleeve contacts a top edge of the side flange 15 and resiliently deforms. Once the strap 12 is positioned at a different recess 19, force on the strap 13 is released and the rubber sleeve can spring back to its undeformed state and urge the tab 20 into engagement with the recess 19. What is common to all of the various embodiments described above is that the strap 12 has a resilient end (whether the end of the strap 12 has an aperture, a resilient member 22 attached to the strap 12 below the tab 20, a rubber sleeve attached to the end of the strap 12 above the tab 20, etc. ) that can deform to allow the strap 12 to be moved from one mounting position to another. As used herein, the reference to the end of the strap refers to any portion of the strap that interfaces with the base 11, and is not limited to the very tip of the strap.

Figure 6:
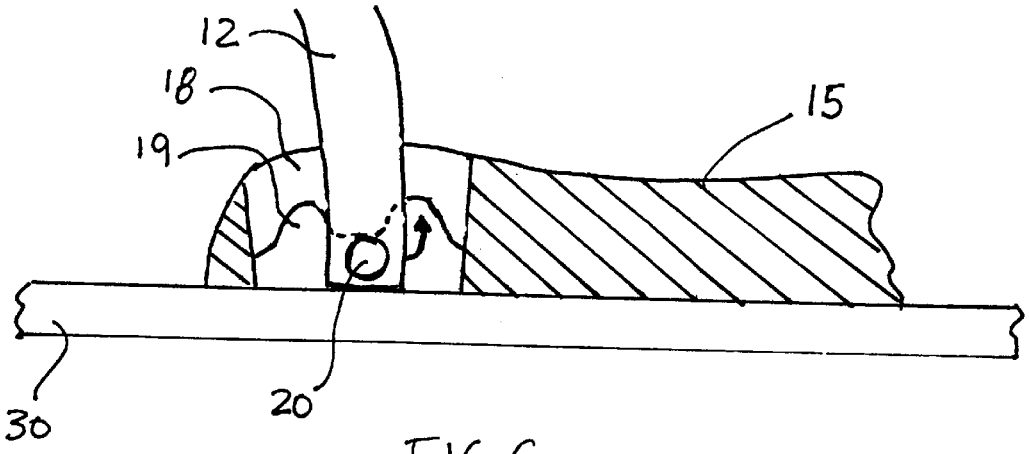
FIG. 6 is a cross-sectional side view of the toe strap mounting portion of the side flange of the snowboard binding of FIG. 1, and shows a strap being moved from a first mounting position to a second mounting position.

FIG. 6 shows the embodiment of FIG. 2 while the strap 12 is being moved from a first mounting position near a front, or toe end, of the binding 10 to a second mounting position near a rear, or heel end, of the binding 10. In this example, a disengaging force has been placed on the strap 12 to deform the resilient end of the strap 12 so that the aperture 21 is closed, or nearly closed. Since the strap 12 end is deformed, the tab 20 can be moved toward the snowboard 30 and disengaged from the front recess 19. Once the tab 20 is disengaged from the front recess 19, the strap 12 can be moved to the rear mounting position. When the strap 12 is at the rear mounting position, the disengaging force on the strap 12 is released and the resilient end of the strap 12 recovers and urges the strap 12 upward so the tab 20 engages with the rear recess 19. Therefore, when no disengaging force is on the strap 12, the resilient end of the strap 12 maintains engagement of the tab 20 with the recess 19.

Figure 7:
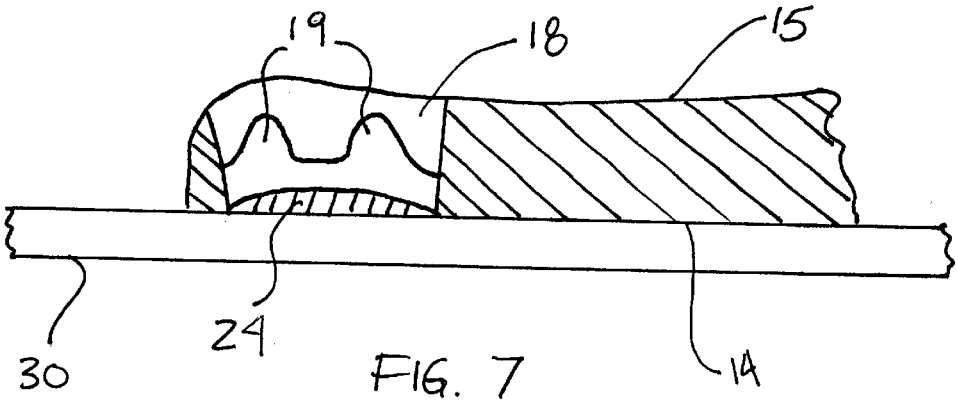
FIG. 7 is a cross-sectional side view of the toe strap mounting portion of a side flange of a snowboard binding having a resilient shelf located near a bottom of a slot.

In several of the embodiments described above, the strap 12 has a resilient end to urge the tab 20 into the recess 19, while allowing tool-free adjustment of the position of the strap 12. However, a similar result can be achieved in other ways. For example, FIG. 7 shows an alternate embodiment in which a resilient shelf 24 is positioned near a bottom of the slot 18. The resilient shelf 24 can be a leaf spring, a group of leaf springs, an elastic material (e.g., rubber), or any other material or device that can provide an upward force on an end of the strap 12 to keep the strap 12 in a particular mounting position, but can be deformed to allow the strap 12 to be disengaged and moved to another mounting position. The resilient shelf 24 can lie on a bottom surface of the slot 18 (if the slot 18 does not pass entirely through the flange 15), can extend from a sidewall of the slot 18, can lie atop the bottom 14 of the base 11 or on the top surface of the snowboard 30, or can lie atop the side flange 15 top edge near the slot 18. In the latter example, the strap 12 may have a shoulder or other feature that engages with the resilient shelf 24 at the top edge of the side flange 15.

In another alternate arrangement, the resilient shelf 24 can be omitted entirely. For example, the resilient shelf 24 in FIG. 7 can be omitted. Therefore, no portion need deform when a disengaging force is placed on the strap 12. Instead, the tab 20 can be disengaged from a recess 19 and moved to another mounting position without deforming any member. With such an arrangement, there is no resilient shelf 24 or resilient end of the strap 12 to keep the strap 12 engaged at a mounting position in the absence of a disengaging force. In one embodiment, a feature can be added to prevent the strap 12 from unintentionally disengaging from the mounting position selected by a rider, although this is not required. For example, the slot 18 can be tapered so that a top end of the slot 18 is more narrow than a bottom end. This tapering would allow the tab 20 to freely move at a bottom of the slot 18, but have a tight interference fit with the slot 18 sidewalls when fully engaged with a recess 19. Unwanted disengagement may also be prevented by positioning a manually activated gate or other obstruction in the slot 18, such as a flexible wall that may be moved aside or bent over by a rider moving the strap 12 from one mounting position to another, to prevent unintentional movement of the strap 12. In another embodiment, the slot 18 may include only a single elongated recess 19, e.g., in the form of a channel, along which the strap 12 can be positioned. Once the strap 12 is positioned at one end of the slot 18 (e.g., a heel end of the slot 18), a plug can be inserted into the slot 18 (e.g., at the toe end of the slot 18) to prevent movement of the strap 12 to another mounting position. The strap 12 may be moved within the slot 18 by removing the plug, moving the strap 12 to the other end of the slot 18, and replacing the plug either at the same place in the slot 18 or at another location in the slot 18. The plug may be inserted downwardly into the slot 18 or through a hole in the side flange 15 perpendicular to the slot 18 sidewall, for example.

Figure 8:
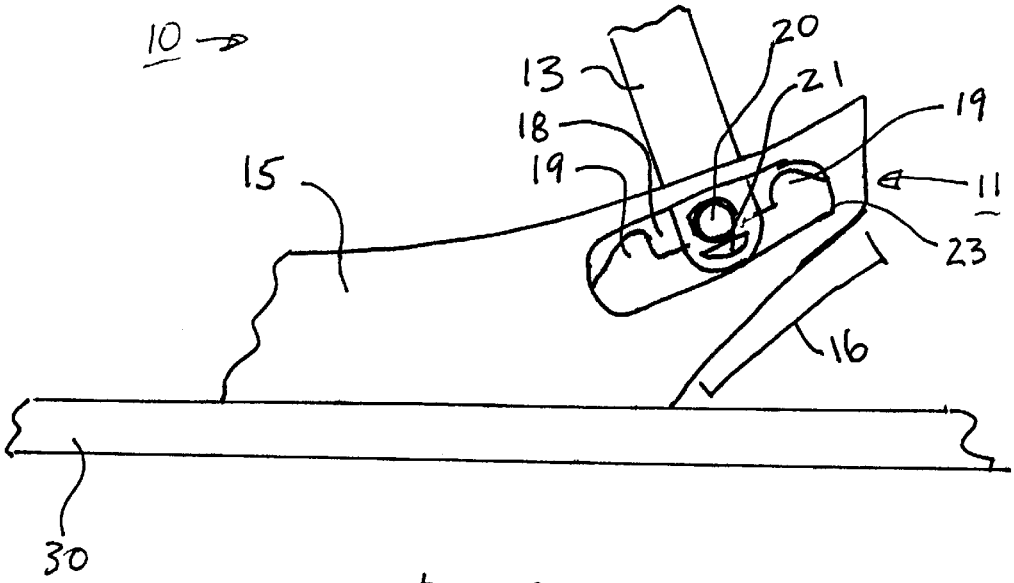
FIG. 8 is a side view of the heel strap mounting portion of the snowboard binding of FIG. 1.

FIG. 8 shows one embodiment of a binding having an adjustable ankle strap 13. In this embodiment, a rear detent 16 is partially formed in a rear portion of the side flange 15, similar to that shown for a front detent 16 in FIGS. 2–7. As discussed above, the detents 16 can be separate devices attached to the side flange 15, or otherwise attached to the base 11. In this embodiment, the detent 16 includes a slot 18 that is formed in the side flange 15 and extends from a top edge toward a bottom edge of the side flange 15, but does not pass through the bottom edge of the side flange 15. The slot 18 in this example includes three recesses 19 formed in an inner side, i.e., a side nearest the rider's foot, of the slot 18. Thus, in this example, the rear detent 16 has three selectable mounting positions. As in the previous examples, the recesses 19 can be tapered to allow easier location of the tab 20 into the recess 19. However, the recesses 19 can have different profiles as the invention is not limited to any particular arrangement. For example, the recesses 19 can have a profile that is only slightly larger than the size of the tab 20 so that the tab 20 fits snugly within the recess 19 and cannot drop out of the recess 19 and potentially move in a heel-to-toe direction once engaged.

A window 23 can also be provided in an outer side of the side flange 15 to expose the slot 18. The window 23 can be used to confirm the position of the strap 13 within the detent 16 and/or to allow insertion of the strap 13 into the slot 18. For example, the strap 13 end without the tab 20 can be inserted into the slot 18, and then the tab 20 can be inserted into the strap 13 and one of the recesses 19, or if integral with the strap 13, can feed through the window 23 and out of the slot 18. The window 23 can include one or more openings and need not expose all of the recesses 19. Thus, the window 23 (or windows) could only expose a small portion of the slot 18, e.g., a portion between recesses 19. However, the window 23 is not necessary and may be omitted. If the window 23 is omitted, the slot 18 may be formed through a bottom edge of the side flange 15 to allow the strap 13 to be inserted into the slot 18, e.g., the strap 13 without a tab 20 is inserted from a top opening of the slot 18 through the bottom opening so that the tab 20 can be attached to the strap 13. After the strap 13 is mounted in the slot 18, a plug can be inserted into the bottom opening of the slot 18 to prevent the strap 13 from dropping out of the slot 18. The plug may provide a resilient shelf 24 or other surface that the strap 13 end can contact, e.g., when the strap 13 is moved from one mounting position to another. The plug can be fixed in the bottom opening of the slot 18 by an interference fit, snap-type closures, an adhesive, one or more screws, etc. In addition, the plug may function to lock the strap 13 into a particular mounting position so that the plug is removed to allow the strap 13 to be moved to another mounting position. In such a case, the plug can be configured to allow tool-free removal of the plug from the slot 18.

Similar to the embodiments described above, the strap 13 can be moved from one mounting position to another by exerting a disengaging force on the strap 13 to move the strap 13 out of engagement with a recess 19, and (where the detent 16 includes a resilient end of the strap 13 or a resilient shelf 24) to deform the resilient end of the strap 13 or resilient shelf 24 to enable the position of the strap 13 to be adjusted. As with the embodiments discussed above, the end of the strap 13 can include an aperture 21 that can be deformed by downward force on the strap 13, other features can be formed in the strap 13 end (such as multiple holes, grooves or slots), a resilient member 22 can be attached to the strap 13, etc., to form a resilient end of the strap 13. Alternately, a resilient shelf 24 can be positioned at a bottom of the surface of the slot 18 similar to that shown in FIG. 7, or in other locations as discussed above.

Figure 9:
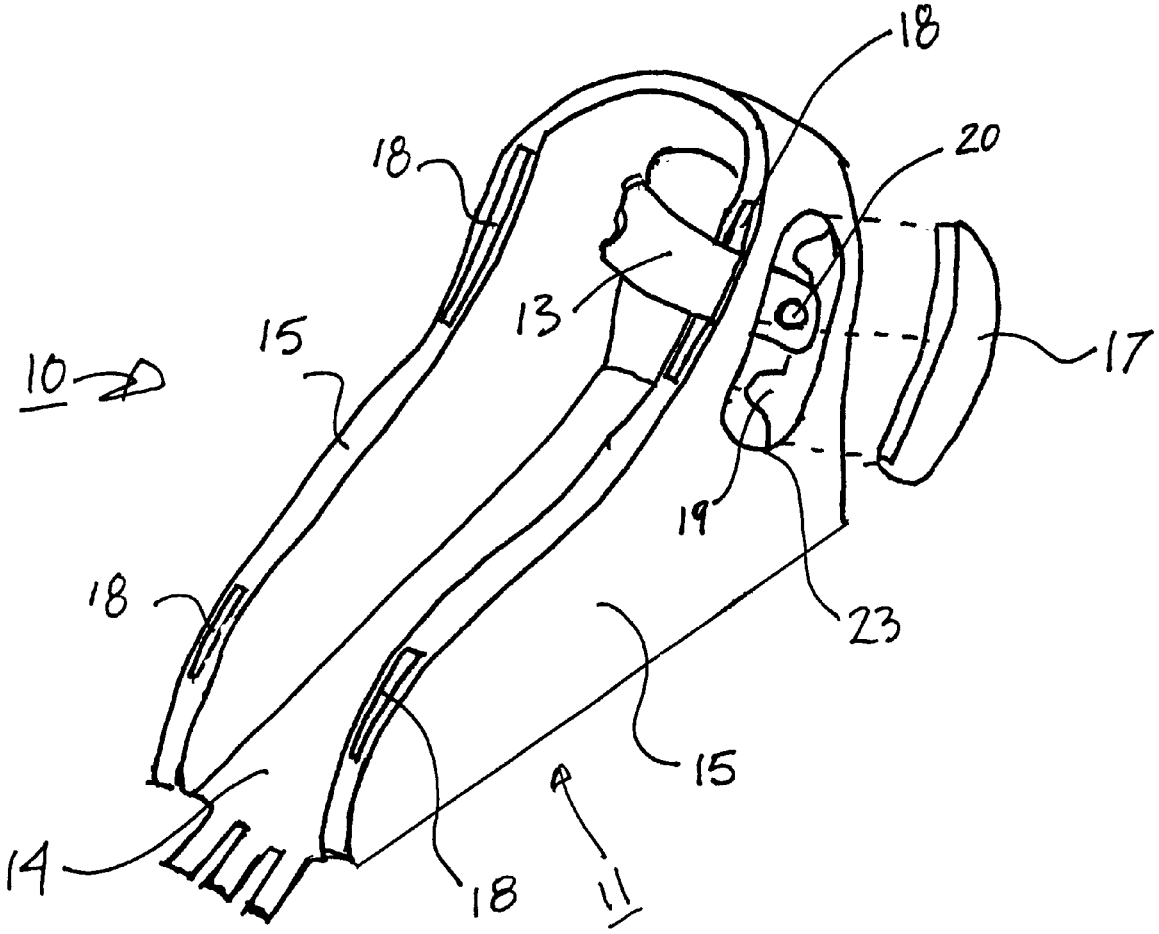
FIG. 9 is a perspective view of the snowboard binding of FIG. 1.

FIG. 9 shows a perspective view of a portion of the binding 10 without all of the strap components. As shown in FIG. 9, a cover 17 can be positioned to cover the window 23, and can be fixed within the window 23 by an interference fit, snap-type closures, an adhesive, one or more screws, or any other suitable mechanism or method. An inner surface of the cover 17 can also include the set of recesses 19 that engage with the tab 20 of the strap 13. In an alternate arrangement, no resilient end or resilient shelf 24 is used and the slot 18 and the strap 13 end are configured so that once the strap 13 is at a particular mounting position and the cover 17 is in place, the strap 13 cannot be moved to another mounting position. Thus, the cover 17 can act as, or include, a gate or other obstruction to prevent unwanted movement of the strap 13 between mounting positions. To move the strap 13, the cover 17 is removed (or a portion of the cover 17 is moved or removed), the strap 13 is moved to another mounting position, and the cover 17 is replaced. Therefore, to allow tool-free adjustment of the strap, the cover 17 is preferably adapted to allow removal from the window 23 without using coins, screwdrivers, or other tools. The invention is not limited to a cover lock, as some embodiments may lock the strap into position like that described above, and the cover 17 may just close the window 23.

As with the embodiments discussed above, tool-free adjustment also may be achieved without the use of a resilient end of the strap 13, resilient shelf 24, or removal of the cover 17. In this arrangement, a disengaging force on the strap 13 can disengage the strap 13 from one mounting position and the strap 13 can be moved to another mounting position without removing the cover 17 or deforming any member. As discussed above, a manually actuated gate or other obstruction, or a tight interference fit between the tab 20 and the recess 19 or slot 18, or other feature or mechanism may optionally be used to prevent the tab 20 from disengaging from a recess 19 after placed in a selected position.

Having thus described certain embodiments of the present invention, various alterations, modifications, and improvements will readily occur to those skilled in the art. For example, the illustrative embodiments of the invention described above are directed to a snowboard binding for use with a snowboard. However, the invention can be used with other types of snowboard bindings, such as those used for snowshoes or other applications in which a foot is bound to a device other than a snowboard. Such alterations, modifications, and improvements are intended to be within the spirit and scope of the invention. Accordingly, the foregoing description is by way of example only, and not intended to be limiting.

What is claimed is:

1. A snowboard binding comprising:

a base;

at least one binding strap having a resilient end; and at least two strap mounting features, supported by the base, adapted to mount the at least one binding strap to the base in at least two mounting positions, the strap mounting features and the at least one binding strap being configured to allow the at least one binding strap to be selectively moved between the at least two strap mounting positions;

wherein the resilient end tends to retain the strap end in one of the mounting positions and is deformable to allow the strap to be selectively disengaged from the one of the mounting positions and moved to another of the mounting positions.

2. The binding of claim 1, wherein the base includes a bottom and a side flange supported by the bottom, and wherein the strap mounting features are disposed at the side flange.

3. The binding of claim 2, wherein the side flange includes a slot that extends from a top of the side flange toward a bottom of the side flange.

4. The binding of claim 3, wherein the slot has opposite sidewalls, at least one of the sidewalls including the at least two strap mounting features, and wherein the at least two strap mounting features are adapted to engage with the at least one strap to prevent the strap from being withdrawn upwardly from the slot.

5. The binding of claim 3, wherein the side flange has an outer side including a window formed therein that exposes at least a portion of the slot.

6. The binding of claim 5, further including a cover that covers the window.

7. The binding of claim 4, wherein the at least two strap mounting features are recesses formed at sidewalls within the slot.

8. The binding of claim 1, wherein the strap is formed of at least two materials including a first material that forms a body of the strap and a resilient material that forms a resilient end of the at least one binding strap.

9. The binding of claim 1, wherein the resilient end of the at least one binding strap has at least one aperture to form the resilient end.

10. The binding of claim 1, wherein:

the base includes a bottom and a side flange supported by the bottom, the strap mounting features are disposed at the side flange, the side flange includes a slot that extends from a top of the side flange toward a bottom of the side flange, and the resilient end is formed in an end of the at least one binding strap.

11. The binding of claim 1, wherein:

the base includes a bottom and a side flange supported by the bottom, the strap mounting features are disposed at the side flange, and the side flange includes a slot that extends from a top of the side flange only partially through the side flange such that the slot does not extend through a bottom of the side flange.

12. The binding of claim 1, wherein the at least one binding strap is a heel strap.

13. The binding of claim 1, wherein the binding is configured to enable the at least one binding strap to be selectively moved between the at least two strap mounting positions without tools while the base is attached to a snowboard.

14. The binding of claim 1, wherein the base includes a slot, wherein the strap mounting features are recesses formed in the slot and are adapted to engage with an end of the at least one strap, and wherein the at least one strap includes a tab adapted to engage with the recesses.

15. A gliding apparatus comprising:

a snowboard; and the snowboard binding of claim 1 attached to the snowboard.

16. A snowboard binding comprising:

a base;

at least one binding strap;

at least two strap mounting features, supported by the base, adapted to mount the at least one binding strap to the base in at least two mounting positions, the strap mounting features and the at least one binding strap being configured to allow the at least one binding strap to be selectively moved between the at least two strap mounting positions; and a resilient shelf, supported by the base, that tends to retain the strap end in one of the mounting positions and is deformable to allow the strap to be selectively disengaged from the one of the mounting positions and moved to another of the mounting positions.

17. The binding of claim 16, wherein the base includes a bottom and a side flange supported by the bottom, and wherein the strap mounting features are disposed at the side flange.

18. The binding of claim 17, wherein the side flange includes a slot that extends from a top of the side flange toward a bottom of the side flange.

19. The binding of claim 18, wherein the slot has opposite sidewalls, at least one of the sidewalls including the at least two strap mounting features, and wherein the at least two strap mounting features are adapted to engage with the at least one strap to prevent the strap from being withdrawn upwardly from the slot.

20. The binding of claim 18, wherein the side flange has an outer side including a window formed therein that exposes at least a portion of the slot.

21. The binding of claim 20, further including a cover that covers the window.

22. The binding of claim 19, wherein the at least two strap mounting features are recesses formed at sidewalls within the slot.

23. The binding of claim 16, wherein:

the base includes a bottom and a side flange supported by the bottom, the strap mounting features are disposed at the side flange, the side flange includes a slot that extends from a top of the side flange toward a bottom of the side flange, and the resilient shelf is positioned near a bottom of the slot.

24. The binding of claim 16, wherein:

the base includes a bottom and a side flange supported by the bottom, the strap mounting features are disposed at the side flange, and the side flange includes a slot that extends from a top of the side flange only partially through the side flange such that the slot does not extend through a bottom of the side flange.

25. The binding of claim 16, wherein the at least one binding strap is a heel strap.

26. The binding of claim 16, wherein the binding is configured to enable the at least one binding strap to be selectively moved between the at least two strap mounting positions without tools while the base is attached to a snowboard.

27. The binding of claim 16, wherein the base includes a slot, wherein the strap mounting features are recesses formed in the slot and are adapted to engage with an end of the at least one strap, and wherein the at least one strap includes a tab adapted to engage with the recesses.

28. A gliding apparatus comprising:

a snowboard; and the snowboard binding of claim 16 attached to the snowboard.

* * * * *